US005911867A

United States Patent [19]

Rolander et al.

[11] Patent Number: 5,911,867

[45] Date of Patent: Jun. 15, 1999

[54] METHOD FOR OBTAINING A HIGH SURFACE FINISH ON TITANIUM-BASED COATINGS BY ELECTROPOLISHING

[75] Inventors: Ulf Rolander; Hans Johansson, both of Stockholm, Sweden

[73] Assignee: Sandvik AB, Sandviken, Sweden

[21] Appl. No.: 08/867,417

[22] Filed: Jun. 2, 1997

[30] Foreign Application Priority Data

Jul. 19, 1996 [SE] Sweden ..... 9602817

[51] Int. Cl.[6] ..... C25F 3/16

[52] U.S. Cl. ..... 205/674; 205/684

[58] Field of Search ..... 205/684, 675, 205/676, 678

[56] References Cited

U.S. PATENT DOCUMENTS

| | | | |
|---|---|---|---|
| 2,997,429 | 8/1961 | Rohrer et al. | 205/684 X |
| 4,405,422 | 9/1983 | Blomsterberg . | |
| 4,411,751 | 10/1983 | Blomsterberg . | |
| 5,202,003 | 4/1993 | Gordon . | |
| 5,227,036 | 7/1993 | Gordon . | |
| 5,591,320 | 1/1997 | Rolander . | |
| 5,650,059 | 7/1997 | Shumaker et al. | 205/684 X |

OTHER PUBLICATIONS

Dialog Information Services, File 351, World Patent Index 81–96, Dialog Accession No. 010641197, WPI Accession No. 96–138150/199614, Chebosky Khiprom PRDN Assoc: "Titanium Nitride Film Removal from Surface of Stainless Steel Articles—comprises treatment in potassium hydrate prior to treating the article in hot soln. of a mineral acid"; & RU, C1,2039851, Jul. 1995, 920817, 199614 B.

Patent Abstracts of Japan, vol. 13, No. 156, C–585, Abstract of JP,A63–313000 (Seiko Instr & Electronics Ltd), Dec. 21, 1988.

Dialog Information Services, File 351, Dialog Acc. No. 008679502, Derwent Acc. No. 91–182522/25, Week 9125, abstract of JP–A–3111600, May 1991.

*Primary Examiner*—Donald R. Valentine

*Attorney, Agent, or Firm*—Burns, Doane, Swecker & Mathis, LLP

[57] ABSTRACT

The present invention relates to a method for polishing coated cutting tools and wear parts, where at least the outer layer of the coating consists of TiN, TiC or Ti(C,N), to a high surface finish. An electrolytic method is used with an electrolyte consisting of perchloric ($HClO_4$) or sulphuric ($H_2SO_4$) acid, 2–50 volume %, in methanol or other organic liquid. The method is easier to control than conventional mechanical methods and renders a high surface finish over the whole coated part.

10 Claims, 1 Drawing Sheet

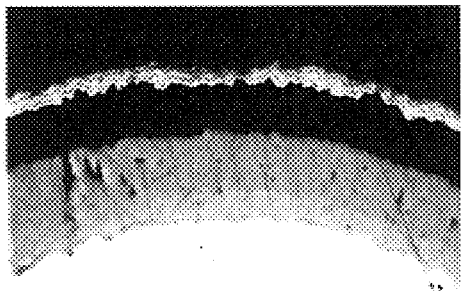
1a
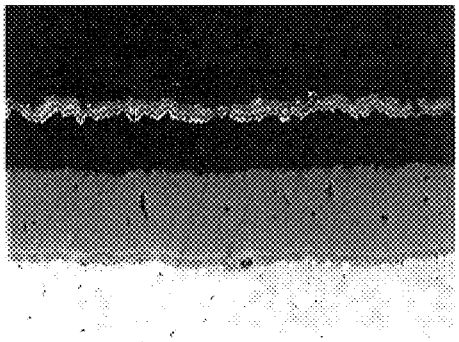
1b
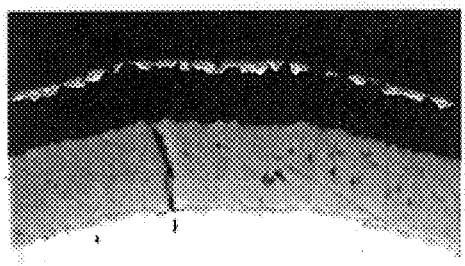
2a
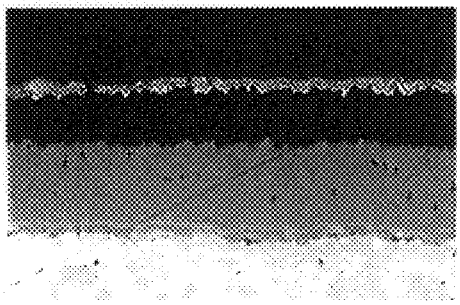
2b
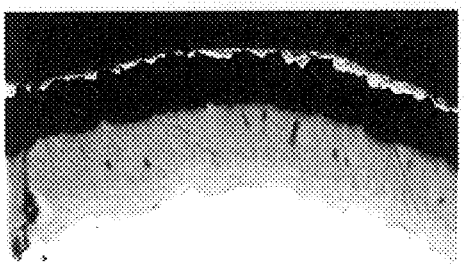
3a
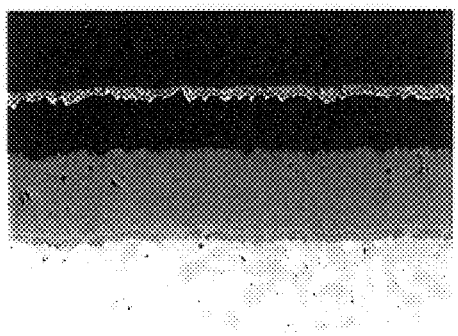
3b
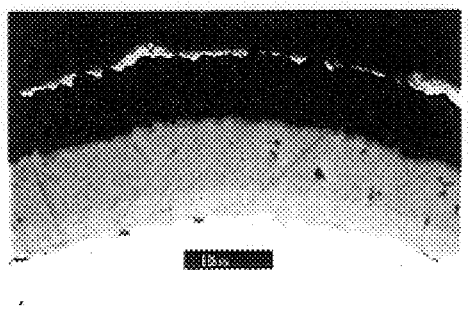
4a
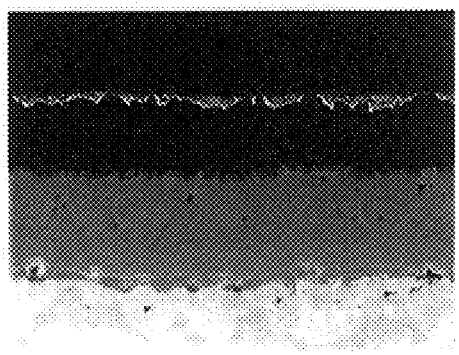
4b
Fig. 1 - 4

METHOD FOR OBTAINING A HIGH SURFACE FINISH ON TITANIUM-BASED COATINGS BY ELECTROPOLISHING

BACKGROUND OF THE INVENTION

The present invention relates to a method for polishing thin TiC, Ti(C,N) or TiN coatings, applied on, e.g., cutting tools, to an extremely high surface finish using the electropolishing technique.

Thin wear resistant coatings of one or more layers of TiC, TiN, Ti(C,N) and/or $Al_2O_3$, are commonly applied on cutting tools and wear parts in order to increase their abrasive and chemical wear resistance. These coatings typically have a total thickness of 1–20 $\mu$m and are applied using chemical vapor deposition (CVD), physical vapor deposition (PVD) and/or related techniques. The surface roughness of the coating after deposition depends on the roughness of the surface coated, on the total coating thickness and on the type of coating applied. In general, the surface of the coating will have at least the same roughness as the initial coated surface, the roughness will increase with coating thickness and a coating containing a layer of $\alpha$-$Al_2O_3$ will be rougher than one containing $\kappa$-$Al_2O_3$ or Ti-comprising layers only.

One particularly interesting family of coatings is illustrated in FIGS. 1*a–b*. Excluding some very thin bonding layers, the coating has an inner layer of Ti(C,N) deposited onto a cemented carbide cutting tool insert, an intermediate layer of $\alpha$-$Al_2O_3$ and a top layer of TiN. As deposited, this coating has unacceptable surface roughness, originating mainly from the rough $\alpha$-$Al_2O_3$ layer. This leads both to inferior performance and to a brownish, rather unattractive color of the insert. A smooth top layer of TiN generally has a shiny golden color which is sought for cosmetic reasons. Today these problems are avoided either by using thermodynamically less stable $\kappa$-$Al_2O_3$ instead of $\alpha$-$Al_2O_3$, by mechanically polishing the $\alpha$-$Al_2O_3$ layer before depositing TiN or by mechanically polishing the TiN layer. The first method in many cases leads to inferior performance. The second method is an expensive two-step deposition process and the third method does not render the desired shiny golden color.

Electrolytic smoothing or deburring is a commonly employed technique, especially for metallic materials. Two well-known processes are called electrochemical deburring and electropolishing. U.S. Pat. No. 4,405,422 discloses methods for electrolytic deburring of copper or copper alloys and U.S. Pat. No. 4,411,751 of steel or aluminum alloys. In U.S. Pat. No. 5,591,320 and Swedish Application No. 9602278-5, which corresponds to U.S. Ser. No. 07/556,952 now U.S. Pat. No. 5,200,311 methods for edge rounding and edge rounding and complete insert surface finishing, respectively, of cutting tool inserts by electropolishing in an electrolyte containing different amounts of perchloric ($HClO_4$) and/or sulphuric ($H_2SO_4$) acid in methanol are presented. Common for all these methods is that they are designed to produce smooth edges essentially without depth effect, each on a specific class of materials, and that they are applied prior to any coating process. Thus, any roughness originating from the coating itself is not eliminated.

OBJECTS AND SUMMARY OF THE INVENTION

It is an object of this invention to avoid or alleviate the problems of the prior art.

It is an object of the present invention to provide a method for directly polishing the coating of cutting tool inserts, as well as drills, endmills and wear parts where at least the outermost layer of the coating consists of TiC, TiN or Ti(C,N).

It is an aspect of the invention to provide a method for polishing cutting tools and wear parts having an outer layer of TiC, TiN or Ti(C,N), to a high surface finish comprising:

providing an electrolyte of 2–50 volume % perchloric ($HClO_4$) or sulphuric ($H_2SO_4$) acid, or a mixture thereof, in an organic liquid carrier;

submerging said coated parts into the electrolyte;

providing an electrode of an acid resistant material within the electrolyte; and applying an electrical potential between the coated part (anode) and the electrode (cathode) for a period of time sufficient to polish the outer layer.

BRIEF DESCRIPTION OF THE DRAWINGS

FIGS. 1(*a*) and (*b*) show in cross-section the nose (*a*) and clearance face (*b*) of a CVD-coated cemented carbide cutting tool insert prior to treatment.

FIGS. 2(*a*) and (*b*) show in cross-section the nose (*a*) and clearance face (*b*) of a CVD-coated cemented carbide cutting tool insert treated for 15 seconds according to the invention.

FIGS. 3(*a*) and (*b*) show in cross-section the nose (*a*) and clearance face (*b*) of a CVD-coated cemented carbide cutting tool insert treated for 60 seconds according to the invention.

FIGS. 4(*a*) and (*b*) show in cross-section the nose (*a*) and clearance face (*b*) of a CVD-coated cemented carbide cutting tool insert treated for 120 seconds according to the invention.

DETAILED DESCRIPTION OF THE PREFERRED EMBODIMENTS OF THE INVENTION

The method of the present invention can be more carefully controlled than mechanical polishing and renders a high surface finish over the whole insert. In particular, a TiN coating applied onto a rough $Al_2O_3$ layer may be polished to essentially eliminate the surface roughness and produce a shiny golden color over the whole polished part.

It has surprisingly been found that by using methods similar to those disclosed in U.S. Pat. No. 5,591,320 and Swedish Application No. 9602278-5 but applying them after, instead of prior to, the coating process, an extremely smooth surface with excellent cosmetic properties, which cannot be made by mechanical methods, is obtained. Furthermore, since it is the coating and not the underlying material that is polished, the method is no longer limited to parts of cemented carbide and cermet alloys, but can also be applied to coated parts of, e.g., high speed steel or ceramics.

According to the present invention, the coated parts, having a single or multiple layer coating with TiN, TiC or Ti(C,N) as outermost layer, are first thoroughly cleaned, e.g., by ultrasonic cleaning in methanol so that dust, loose particles, grease stains etc., that may affect the polishing result are removed from the surfaces. The parts are then submerged in the electrolytic bath and a voltage is applied between the parts (anode) and a cathode. Strong agitation is carried out in order to obtain stable conditions with electrolyte flowing along all sides of the parts. The cathode should be made of an acid resistant material, e.g., platinum or acid resistant stainless steel.

The electrolyte shall contain 2–50 volume %, preferably 20–30 volume % perchloric ($HClO_4$) or sulphuric ($H_2SO_4$) acid, or a mixture thereof, in methanol. Methanol may be partly or fully substituted by more viscous fluids, e.g., another lower alcohol such as butanol or glycerol or ethylene-glycol-monobutylether, in order to decrease the polishing speed or as a means for obtaining more stable conditions. The temperature of the electrolyte may be varied between room temperature and −60° C., mainly in order to change the viscosity of the electrolyte.

The voltage shall be lower than 50 V but higher than 3 V, preferably 10–30 V. Generally a DC-voltage is used. But it is also possible to use pulsed or AC-voltage. The proper choice of voltage depends on the design of the equipment used, the degree of agitation obtained and the choice of electrolyte and temperature. The choice of electrolyte, temperature, applied voltage and polishing time should be adapted to the coating material and thickness, initial surface roughness and desired final thickness to obtain the best result. It is within the purview of the skilled artisan to determine these conditions.

Immediately afterwards, the polished parts are rinsed, e.g., in methanol, in order to avoid corrosion caused by the electrolyte. With a correct choice of the different parameters described above, a thin, highly viscous layer is formed at the interface between coating and electrolyte. Since the voltage drop occurs mainly across this layer, the polishing speed will depend strongly on its thickness. Therefore, on a rough surface, protruding parts will be polished faster than grooves, leading to a continuously decreasing surface roughness. On the other hand, if the choice of parameters is too far from the optimum, the viscous layer will never be formed or will be unstable, leading to oxidation or even pitting of the surface.

The method is suitable for mass production since large surface areas can be polished simultaneously with high polishing speed and extremely high accuracy and reproducibility.

The invention is additionally illustrated in connection with the following Example which is to be considered as illustrative of the present invention. It should be understood, however, that the invention is not limited to the specific details of the Example.

EXAMPLE

Cemented carbide inserts with a multiple layer coating as shown in FIG. 1 were electropolished for 15, 60 and 120 seconds, respectively, using an electrolyte of 22 volume % sulphuric acid in methanol, cooled to −50° C., and a DC-voltage of 20 volts. A 30 $cm^2$ platinum sheet was used as cathode and the electrolyte was stirred strongly using a magnetic mixer. As seen in FIG. 2, already after 15 seconds a substantial improvement of the surface roughness is obtained, especially over the nose. After 60 seconds, FIG. 3, the smoothness has been improved further at the clearance face. After 120 seconds, FIG. 4, protruding parts of the $Al_2O_3$ layer have reached the surface of the TiN layer. An extremely smooth surface has been obtained over the whole insert, with TiN neatly filling out the grooves of the underlying $Al_2O_3$ layer. Most of the TiN has been removed and it no longer forms a continuous layer. In this particular case, the process is actually self controlled. As the protruding parts of the electrically insulating $Al_2O_3$ reaches the surface, the electrical contact to the islands of TiN in the grooves is cut off and the polishing stops. A similar effect is obtained when polishing a Ti-comprising coating on an electrically insulating ceramic part. However, the method works equally well on coated parts where all layers in the coating, as well as the part itself, are electrically conducting, though careful control of the polishing time may be more important in such a case.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method for polishing coated cutting tool parts and coated wear parts having an outer layer of TiC, TiN or Ti(C,N), to a high surface finish comprising:

providing an electrolyte of 2–50 volume % perchloric ($HClO_4$) or sulphuric ($H_2SO_4$) acid, or a mixture thereof, in an organic liquid carrier;

submerging said coated parts into the electrolyte;

providing an electrode of an acid resistant material within the electrolyte; and applying an electrical potential between the coated part (anode) and the electrode (cathode) for a period of time sufficient to polish the outer layer.

2. The method of claim 1 wherein the electrolyte comprises 20–30 volume % of perchloric acid, sulphuric acid or a mixture thereof.

3. The method of claim 1 wherein the electrode is made of platinum.

4. The method of claim 1 wherein the electrode is made of an acid resistant stainless steel.

5. The method of claim 1 wherein the organic liquid carrier comprises a lower alcohol.

6. The method of claim 5 wherein the organic liquid carrier is methanol.

7. The method of claim 1 wherein the electrical potential is applied at a voltage of above 3 but less than 50 volts.

8. The method of claim 7 wherein the electrical potential is applied at a voltage of 10–30 volts.

9. The method of claim 1 wherein the outer layer comprises TiC.

10. The method of claim 1 wherein the outer layer comprises TiN.

* * * * *